US008087357B2

(12) United States Patent
Denome et al.

(10) Patent No.: US 8,087,357 B2
(45) Date of Patent: Jan. 3, 2012

(54) PROCESS FOR CREATING A UNIT DOSE PRODUCT WITH A PRINTED WATER SOLUBLE MATERIAL

(75) Inventors: Frank William Denome, Cincinnati, OH (US); Xavier Trawka, Ath (BE)

(73) Assignee: The Proctor & Gamble Company, Cincinnati, OH (US)

( * ) Notice: Subject to any disclaimer, the term of this patent is extended or adjusted under 35 U.S.C. 154(b) by 460 days.

(21) Appl. No.: 12/270,534

(22) Filed: Nov. 13, 2008

(65) Prior Publication Data

US 2009/0120316 A1 May 14, 2009

Related U.S. Application Data

(60) Provisional application No. 61/002,956, filed on Nov. 13, 2007.

(51) Int. Cl.

| | |
|---|---|
| ***B41M 1/30*** | (2006.01) |
| ***C11D 17/04*** | (2006.01) |
| ***B65B 9/04*** | (2006.01) |
| ***B65D 65/46*** | (2006.01) |

(52) U.S. Cl. ..... 101/483; 101/490; 510/296; 53/411

(58) Field of Classification Search ..... 101/483, 101/490; 510/296; 493/223; 53/411
See application file for complete search history.

(56) References Cited

U.S. PATENT DOCUMENTS

| | | | |
|---|---|---|---|
| 3,903,328 | A | 9/1975 | Burdette, Jr. et al. |
| 4,170,681 | A | 10/1979 | Edwards et al. |
| 4,830,902 | A | 5/1989 | Plantenga et al. |
| 5,666,785 | A | 9/1997 | Jouffreau et al. |
| 5,766,732 | A | 6/1998 | Claytor |

FOREIGN PATENT DOCUMENTS

| | | | |
|---|---|---|---|
| WO | WO 00/55415 | A1 | 9/2000 |
| WO | WO 03/031266 | A1 | 4/2003 |
| WO | WO 2006/124484 | A1 | 11/2006 |
| WO | WO 2007/034471 | A3 | 3/2007 |

OTHER PUBLICATIONS

International Search Report mailed Mar. 20, 2009, 3 pages.

*Primary Examiner* — Leslie J Evanisko
(74) *Attorney, Agent, or Firm* — Julia A. McConihay; Leonard W. Lewis; Steven W. Miller

(57) ABSTRACT

A process for selectively and repeatedly printing at least two graphics onto a water soluble material to create a randomized print for unit dose products.

9 Claims, 2 Drawing Sheets

PROCESS FOR CREATING A UNIT DOSE PRODUCT WITH A PRINTED WATER SOLUBLE MATERIAL

CROSS REFERENCE TO RELATED APPLICATION

The present application claims priority to U.S. Provisional Application Ser. No. 61/002,956, filed Nov. 13, 2007.

FIELD OF THE INVENTION

A process for creating a unit dose product with a printed water soluble material having a randomized pattern of graphic while still having at least one whole graphic for an available surface area of the unit dose product.

BACKGROUND OF THE INVENTION

Printing onto materials gives an additional interaction between a unit dose product and the user of such a product. The desire for consumers to have customized or seasonal products is also addressed by the use of printing different graphics onto products.

METHOD® automatic dishwashing unit dose products having an ordered repeating pattern of white or gray trademarked symbols printed onto the water soluble film. WO 2007034471 A3 relates to a water-soluble detergent printed film comprising a film support and at least one print, being printed thereon and/or therein said film, said film is a water-soluble detergent adapted for effective cleansing of various human body and goods cleaning. WO 2007034471 also discusses a method of producing a water-soluble detergent printed film, comprising forming a detergent film; and, printing the same with at least one print. U.S. Pat. No. 5,666,785 relates to printing directly on water soluble film and more particularly to a method and apparatus for printing graphics and text directly on water soluble films while the film is in the process of being formed into a water soluble container by a packaging machine. JP 55-034966 relates to print on fruits with distortionless impressions without causing damage to them, by printing on water-soluble film, pasting the film on fruits by using adhesive, and then removing the film by dissolution.

It has been found that a randomized pattern is desired such that each unitized dose does not appear identical. A known process for making unit dose products is to utilize molds attached to a moving belt or other horizontal surface. A roll of water soluble material is placed into the molds and drawn into the molds. The molds having the water soluble material is then filled. A second water soluble material is then used to complete a unit dose product when it is placed on top of the filled mold and sealed to the first water soluble material. The area between the molds is then cut to form the individual unit dose products. Therefore a specific foot print or area is needed to make the unit dose product, the foot print area having a width that is less than the entire width of the water soluble material.

The creation of a randomized pattern to be applied to water soluble material originating from a roll proves to be difficult as graphics or indicia tend to be cut off or prevented from having the entire graphic presented during the formation of the unit dose product. It is undesired to have multiple graphics/indicia only to have less than one whole graphic/indicia present on the unit dose product.

It is therefore desired to have a process for placement of the graphic/indicia onto a water soluble material having a width such that resulting unit dose products formed from the water soluble material have at least two graphics/indicia that are complete and not cut off in visual appearance.

SUMMARY OF THE INVENTION

Process of randomizing printing onto unit dose products comprising the steps of:

Selecting a water soluble material to be printed, the material having an available width;

Selecting the width of the foot print of a unit dose product to be less than the available width of the water soluble material;

Selecting two or more sizes of a graphic such that at least a first graphic and a second graphic result;

Printing repeatedly at different locations on the water soluble material in the available width the first size of graphic onto the water soluble material at an angle of between 10 and 25 degrees wherein the distance between the repeatedly printed first graphic oriented parallel to the available width of the water soluble material is between 2.5× and 5× and the distance between the repeatedly printed first graph oriented perpendicular to the available width of the water soluble material is X;

Printing repeatedly at different locations on the water soluble material in the available width the second size of graphic onto the water soluble material at an angle of between 10 and 25 degrees wherein the distance between the repeatedly printed second graphic oriented parallel to the available width of the water soluble material is between 2.5× and 5× and the distance between the repeatedly printed second graph oriented perpendicular to the available width of the water soluble material is X;

Forming the printed water soluble material into unit dose products.

DETAILED DESCRIPTION OF THE INVENTION

Process is about selecting the correct size ratios between the width of the roll of water soluble material, the desired footprint width and the width of at least two graphics, the process resulting in a printed randomized pattern of the graphic/indicia onto the water soluble material. In one embodiment the two graphics are the same graphic design, only with different dimensions. In another embodiment the two graphics are different graph designs, both having different dimensions, specifically in the width.

Figure 1:
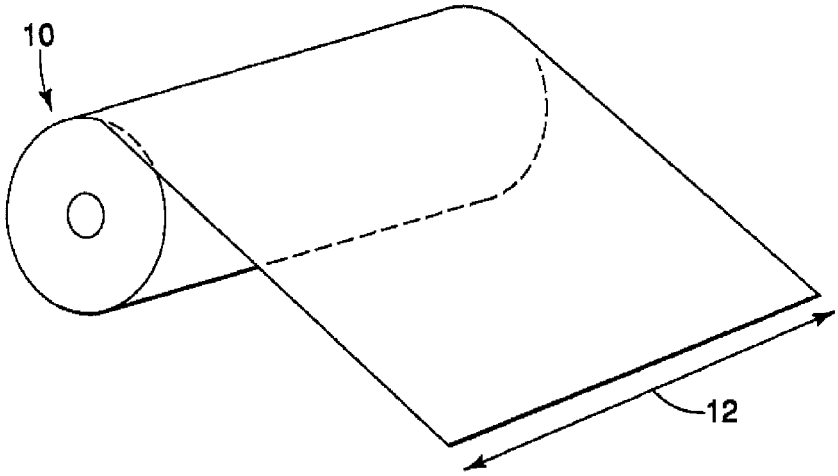
FIG. 1 shows a roll of water soluble material having a width.

FIG. 1 shows a roll of water soluble material 10 having a width 12. The width 12 of the roll 10 may correlate to the width of any mold 18 or platen 14 containing a plurality of molds uses to make the unit does products such as a portion of a platen 14 shown in FIG. 2. As used herein "available width" means the width of the water soluble material that can be utilized for printing of graphics/indicia onto the water soluble material. Reasons for why the width 12 of the water soluble material may not equate to the available width include circumstances where the foot print of the unitized doses has a width that does not result in a whole number of such unitized doses across the width of the water soluble material; a portion along the edges are needed to be non-printed due to tracking equipment that cannot follow a printed surface; other reason associated with manufacture of unit dose products.

Preferably, the unit dose product is made using a mold 18; preferably the mold 18 has round inner side walls and a round inner bottom wall. A water soluble material is placed over the mold. A composition, such as a detergent composition, may then be poured into the water soluble material which then takes the shape of the mold 18, a second water soluble material may be placed over the mold with the composition and the unit dose product may then be sealed. The surface area of the unit dose product preferably has at least on entire graphic present on its surface area. The object of the present application is to describe a process for the placement of a graphic onto a water soluble material such that when used in a process where multiple molds are utilized to make a unit dose product out of the material, the desired presence of at least one entire graphic results.

FIG. 1 shows a roll of water soluble material 10 having a width 12. In one embodiment, the available width is equal to the width 12. In one embodiment, the available width is less than the width 12. The available width of the water soluble material may be from about 200 mm to about 800 mm, preferably from about 200 to about 700 mm. In one embodiment, the available width of the water soluble material can be between about 300 mm and about 400 mm. In one embodiment, the available width of the water soluble material is between 600 mm and about 700 mm.

Figure 2:
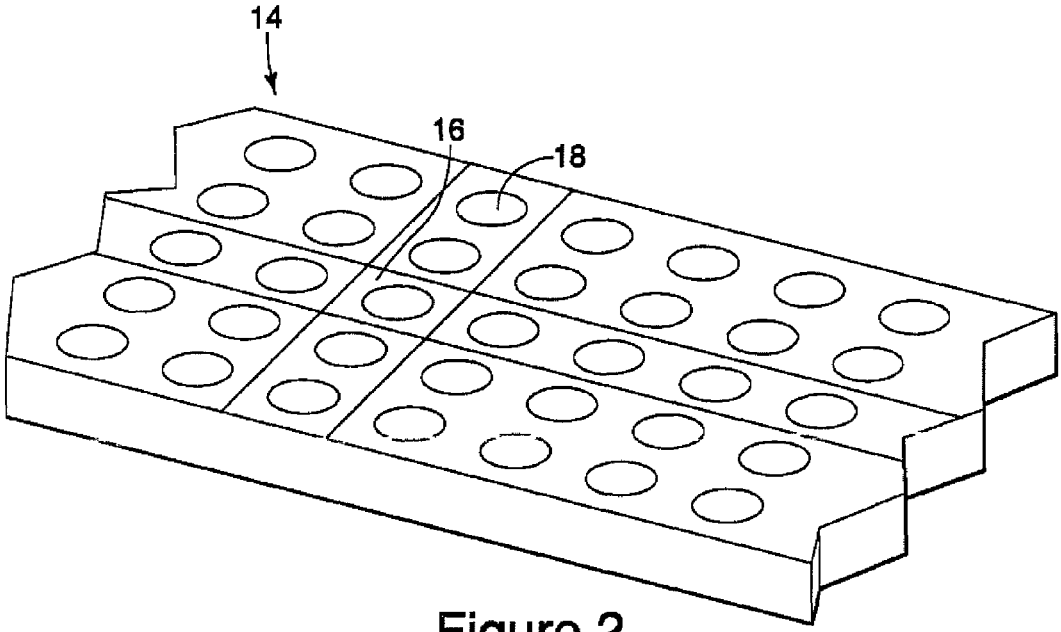
FIG. 2 shows a portion of a platen or mold used to make unit dose products wherein a foot print area is shown.

The available width subdivided into foot print areas 16 shown in FIG. 2 for the formation of the unit dose product. The foot print area 16 will comprise at least one whole graphic selected from a first graphic area having a first graphic width and a second graphic area having a second graphic width and optionally a third/fourth/fifth/etc. graphic area having a third/fourth/fifth/etc. graphic width. The width of the foot print is less than the available width of the water soluble material.

The foot print width may encompass dimensions that are not normally thought of as a "width". For example, if the overall shape of the unit dose product is a circle, oval, star, triangle, or other non-rectangular shape, the overall shape can still have a foot print width as described herein. The "width" dimension for such foot print shapes would relate to a rectangle being drawn around the mold shape, the rectangle width being oriented parallel with the width 12 of the water soluble material roll 10 as shown in FIG. 1; wherein the "height" would be the dimension perpendicular to the width 12 of the water soluble material roll 10 as shown in FIG. 1.

The width of the foot print can be from about 30 mm to about 70 mm. In one embodiment, the height of the foot print is equal to the width of the foot print. In one embodiment, the width of the foot print is from about 35 to 45 mm. In one embodiment, the width of the foot print is from about 50 mm to about 60 mm.

Graphics/Indicia

The graphics or indicia of the present application may be any symbol or shape that can be printed onto the surface of a water soluble material. In some embodiments, the graphic or indicia indicates the origin of said unit dose product; the manufacturer of the unit dose product; an advertising, sponsorship or affiliation image; a trade mark or brand name; a safety indication; a product use or function indication; a sporting image; a geographical indication; an industry standard; preferred orientation indication; an image linked to a perfume or fragrance; a charity or charitable indication; an indication of seasonal, national, regional or religious celebration, in particular spring, summer, autumn, winter, Christmas, New Years; or any combination thereof. Further examples include random patterns of any type including lines, circles, squares, stars, moons, flowers, animals, snowflakes, leaves, feathers, sea shells and Easter eggs, amongst other possible designs.

Figure 3:
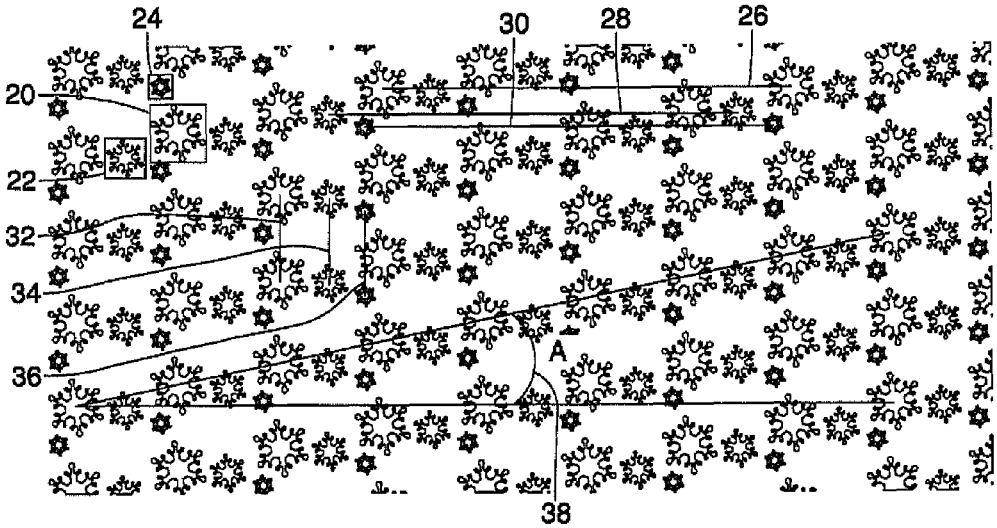
FIG. 3 shows a printed water soluble material having a first graphic, a second graphic and a third graphic wherein all the graphics are the same.
Figure 4:
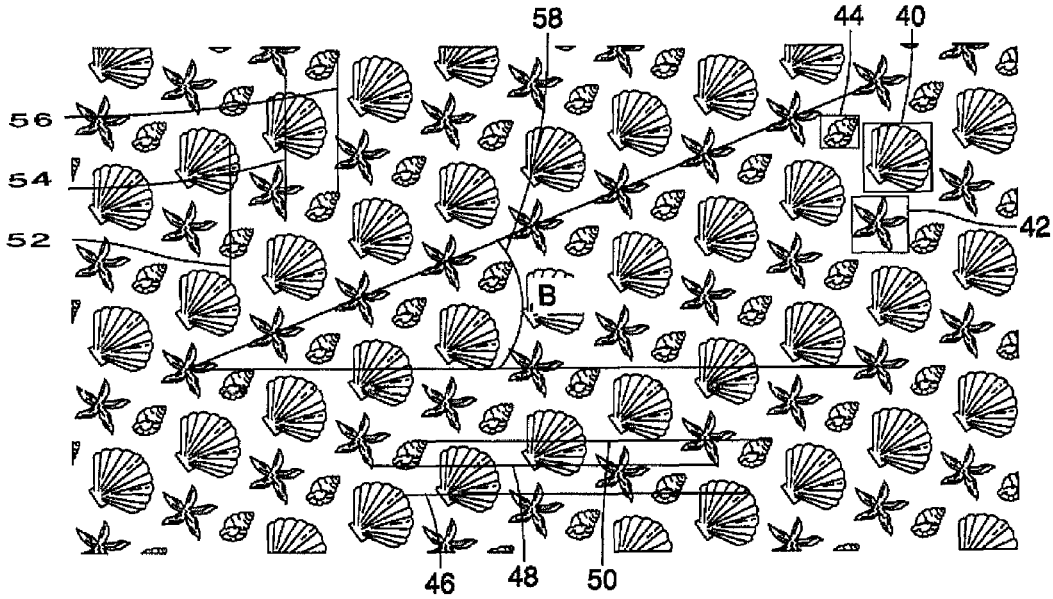
FIG. 4 shows a printed water soluble material having a first graphic, a second graphic and a third graphic wherein all of the graphics are different.

The size and placement of the graphics selected are carefully selected to ensure than an entire graphic is present on each unit dose product. In one embodiment, at least three different size graphics are utilized. The graphics can either be the same, as shown in FIG. 3 (shown with the width of the water soluble material) or different as shown in FIG. 4 (shown with the width of the water soluble material). The area of the graphic(s) can be determined by drawing a rectangle around the graphic such as that shown in FIGS. 3 and 4. The area of the graphics can be selected to be less than the area of the foot print area.

The graphic width may encompass dimensions that are not normally thought of as a "width". For example, if the overall shape of the graphic is a circle, oval, star, triangle, or other non-rectangular shape, the overall shape can still have a graphic width as described herein. The "width" dimension for such shapes would relate to a rectangle being drawn around the graphic as shown in FIG. 3 or 4 with the width of the graphic being oriented parallel with the width of the water soluble material roll as shown in FIG. 1; wherein the "height" would be the dimension perpendicular to the width of the water soluble material roll as shown in FIGS. 3 and 4.

In one embodiment shown in FIG. 3, the ratio of the footprint area 16 to the area of graphic 20 is 1:10 to 1:11. The area of graphic 22 is less than the area of graphic 20. The area of graphic 24 is less than the area of graphic 22 and graphic 20.

In one embodiment shown in FIG. 4, the ratio of the footprint area to the area of graphic 40 is 1:13 to 1:14. The area of graph 42 is less than the area of graphic 40. The area of graphic 44 is less than the area of graphic 42 and graphic 40.

Placement of the graphic is repeated on an angle of between 10 and 25 degrees wherein the distance between the repeated graphic perpendicular to the width of the material is (32, 34, 36, 52, 54, 56) equal to X and the distance between the repeated graphic parallel to the width of the material (26, 28, 30, 46, 48, 50) is equal to 5× to 2.5×

In one embodiment the placement of the graphic is repeated on an angle of 10-15 degrees wherein the distance between the repeated graphic perpendicular to the width of the material (32, 34, 36) is equal to X and the distance between the repeated graphic parallel to the width of the material (26, 28, 30) is equal to 5×.

FIG. 3 shows an embodiment wherein the angle A 38 is 12.5 degrees and the distance between the repeated graphic perpendicular to the width of the material (32, 34, 36) or X is equal to 1 inch and the distance between the repeated graphic parallel to the width of the material (26, 28, 30) is equal to 4.5 inches or 4.5×.

In one embodiment the placement of the repeated graphic is on an angle B of 16-25 degrees and wherein the distance between the repeated graphic perpendicular to the width of the material (52, 54, 56) is equal to X and the distance between the repeated graphic parallel to the width of the material (46, 48, 50) is equal to 2.5×.

FIG. 4 shows an embodiment wherein the angle B 58 is 21.0 degrees and the distance between the repeated graphic perpendicular to the width of the material (52, 54, 56) or X is equal to 1.25 inches and the distance between the repeated graphic parallel to the width of the material (46, 48, 50) is equal to 3.25 inches or 2.6×.

The graphic is repeatedly printed on the water soluble material when it is in sheet form and before being used to form the wall or walls of a unit dose product, preferably a unit dose detergent product.

Preferred methods for printing on the above-mentioned water soluble material include but are not limited to those described in U.S. Pat. No. 5,666,785 and WO 06/124484. Printing is usually done with inks and dyes and used to impart patterns and colors onto a water-soluble material. Any kind of printing can be used, including rotogravure, lithography, flexography, porous and screen printing, inkjet printing, letterpress, tampography and combinations thereof. Preferred for use herein is flexography printing. Flexography is a printing technology which uses flexible raised rubber or photopolymer plates to carry the printing solution to a given substrate.

Preferably the printed water soluble material will form at least one of the outer walls of the unit dose products. In another embodiment all of the outer walls of the unit dose product comprise printed water soluble material.

Water Soluble Material

As used herein "water soluble" means a material that is dissolves under the water soluble test method below at 20° C. within 90 seconds. A detailed discussion of the test method can be found in U.S. Pat. No. 6,787,512 B1.

Cut three test specimens from film sample to a size of 3.8 cm×3.2 cm. If cut from a film web, specimens should be cut from areas of web evenly spaced along the transverse direction of the web. Lock each specimen in a separate 35 mm slide mount. Fill beaker with 500 mL of distilled water. Measure water temperature with thermometer and, if necessary, heat or cool water to maintain temperature at 20° C. (about 68° F.). Mark height of column of water. Place magnetic stirrer on base of holder. Place beaker on magnetic stirrer, add magnetic stirring rod to beaker, turn on stirrer, and adjust stir speed until a vortex develops which is approximately one-fifth the height of the water column. Mark depth of vortex.

Secure the 35 mm slide mount in an alligator clamp of a slide mount holder such that the long end of the slide mount is parallel to the water surface. The depth adjuster of the holder should be set so that when dropped, the end of the clamp will be 0.6 cm below the surface of the water. One of the short sides of the slide mount should be next to the side of the beaker with the other positioned directly over the center of the stirring rod such that the film surface is perpendicular to the flow of the water.

In one motion, drop the secured slide and clamp into the water and start the timer. Disintegration occurs when the film breaks apart. When all visible film is released from the slide mount, raise the slide out of the water while continuing to monitor the solution for undissolved film fragments. Dissolution occurs when all film fragments are no longer visible and the solution becomes clear.

Record the individual and average disintegration and dissolution times and water temperature at which the samples were tested.

Preferred water soluble materials are polymeric materials, preferably polymers which are formed into a film or sheet. The water soluble material can, for example, be obtained by casting, blow-molding, extrusion or blown extrusion of the polymeric material, as known in the art.

Preferred polymers, copolymers or derivatives thereof suitable for use as water soluble material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the water soluble material, for example a PVA polymer, is at least 60%.

The polymer can have any weight average molecular weight, preferably from about 1000 to 1,000,000, more preferably from about 10,000 to 300,000 yet more preferably from about 20,000 to 150,000.

Mixtures of polymers can also be used as the water soluble material. This can be beneficial to control the mechanical and/or dissolution properties of the compartments or water soluble material, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000.

Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol.

Preferred for use herein are polymers which are from about 60% to about 98% hydrolysed, preferably about 80% to about 90% hydrolysed, to improve the dissolution characteristics of the material.

Most preferred water soluble materials are PVA films known under the trade reference Monosol M8630, as sold by MonoSol LLC of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The water soluble material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

Process For Forming Unit Dose Products out of Printed Water Soluble Material

The formation of unit dose products requires only one moving endless surface. Each unit dose product is formed in a single mold. After the web of water soluble material is placed onto the molds, each water soluble material is partially filled, closed and sealed. Sealing steps may be by means of solvent sealing, heat sealing or both.

The process used herein for forming the first and/or second moving webs involves continuously feeding a water-soluble material onto an endless surface, preferably onto a horizontal or substantially horizontal portion of an endless surface, or otherwise, onto a non-horizontal portion of this surface, such that it moves continuously towards and eventually onto the horizontal or substantially horizontal portion of the surface.

In a preferred embodiment for making both the first and second moving webs a portion of the endless surface will move continuously in horizontal rectilinear motion, until it rotates around an axis perpendicular to the direction of motion, typically about 180 degrees, and then move in the opposite direction, usually again in horizontal rectilinear motion. Eventually, the surface will rotate again to reach its initial position. In other embodiments, the surface moves in curvilinear, for example circular motion, whereby at least a portion of the surface is substantially horizontal for a simple but finite period of time. Where employed, such embodiments are mainly valuable for making the second moving web.

The term 'endless surface' as used herein, means that the surface is endless in one dimension at least, preferably only in one dimension. For example, the surface is preferably part of a rotating platen conveyer belt comprising molds such as that shown in FIG. 2, as described below in more detail.

The horizontal or substantially horizontal portion of the surface can have any width, typically depending on the number of rows of molds across the width, the size of the molds and the size of the spacing between molds. Where designed to operate in horizontal rectilinear manner the horizontal portion of the endless surface can have any length, typically depending on the number of process steps required to take place on this portion of the surface (during the continuous horizontal motion of the surface), on the time required per step and on the optimum speed of the surface needed for these steps.

Preferred may be that the width of the surface is up to 1.5 meters, or even up to 1.0 meters or preferably between 30 and 60 cm. Preferred may be that the horizontal portion of the endless surface is from 2 to 20 meters, or even 4 to 12 meters or even from 6 to 10 or even 9 meters.

The surface is typically moved with a constant speed throughout the process, which can be any constant speed. Preferred may be speeds of between 1 and 80 m/min, or even 10 to 60 m/min or even from 2- to 50 m/min or even 30 to 40 m/min.

The process is preferably done on an endless surface which has a horizontal motion for such a time to allow formation of the web of water soluble material, filling of the water soluble material, superposition of a second web of water soluble material, sealing of the two webs of water soluble material and cutting to separate the superposed webs into a plurality of unit dose products. Then, unit dose products are removed from the surface and the surface will rotate around an axis perpendicular to the direction of motion, typically about 180 degrees, to then move in opposite direction, typically also horizontally, to then rotate again, where after step a) starts again.

Preferably, the surface is part of and/or preferably removably connected to a moving, rotating belt, for example a conveyer belt or platen conveyer belt. Then preferably, the surface can be removed and replaced with another surface having other dimensions or comprising molds of a different shape or dimension. This allows the equipment to be cleaned easily and moreover to be used for the production of different types of pouches. This may for example be a belt having a series of platens, whereof the number and size will depend on the length of the horizontal portion and diameter of turning cycles of the surface, for example having 50 to 150 or even 60 to 120 or even 70 to 100 platens, for example each having a length (direction of motion of platen and surface) of 5 to 150 cm, preferably 10 to 100 cm or even 20 to 45 cm.

The platens then form together the endless surface or part thereof and typically the molds are comprised on the surface of the platens, for example each platen may have a number of molds, for example up to 20 molds in the direction of the width, or even from 2 to 10 or even 3 to 8, and for example up to 15 or even 1 to 10 or even 2 to 6 or even 2 to 5 molds lengthwise, i.e. in the direction of motion of the platens. An example of a partial view of such a platen can be seen in FIG. 3.

The surface, or typically the belt connected to the surface, can be continuously moved by use of any known method. Preferred is the use of a zero-elongation chain system, which drives the surface or the belt connected to the surface.

If a platen conveyer belt is used, this preferably contains a) a main belt (preferably of steel) and b) series of platens, which comprise 1) a surface with molds, such that the platens form the endless surface with molds described above, and 2) a vacuum chute connection and 3) preferably a base plate between the platens and the vacuum chute connection. Then, the platens are preferably mounted onto the main belt such that there is no air leakage from junctions between platens. The platen conveyer belt as a whole moves then preferably along (over; under) a static vacuum system (vacuum chamber).

Preferred may be that the surface is connected to 2 or more different vacuum systems, which each provide a different under pressure and/or provide such an under pressure in shorter or longer time-span or for a shorter or longer duration. For example, it may be preferred that a first vacuum system provides a under-pressure continuously on the area between or along the molds/edges and another system only provides a vacuum for a certain amount of time, to draw the material into the molds. For example, the vacuum drawing the material into the mold can be applied only for 0.2 to 5 seconds, or even 0.3 to 3 or even 2 seconds, or even 0.5 to 1.5 seconds, once the material is on the horizontal portion of the surface. This vacuum may preferably be such that it provides an under-pressure of between −100 mbar to −1000 mbar, or even from −200 mbar to −600 mbar.

The molds can have any shape, length, width and depth, depending on the required dimensions of the pouches. Per surface, the molds can also vary of size and shape from one to another, if desirable. For example, it may be preferred that the volume of the final pouches is between 5 and 300 ml, or even 10 and 150 ml or even 20 and 100 ml or even up to 80 ml and that the mold sizes are adjusted accordingly.

Packaging of Printed Unit Dose Products

In further embodiment of the present invention, when multiple unit dose products are stored in a container or containers through at least a portion of which the unit dose products contained therein may be seen, preferably image on the printed material and preferably the optional is linked conceptually to graphic on the portions of the container through which the unit dose products may not be seen through. For example, the printed image may be of a lemon the graphic on the outside of the container may include images of lemons and/or a written reference to the lemon or citrus themes. This provides a strong and reinforced message to the consumer about the benefits of using the product.

In further embodiment of the present invention when multiple unit dose products are stored in a container or containers through at least a portion of which the unit dose products within said container may be seen, preferably a plurality different multi-compartment pouches comprising the printed images. In one embodiment the shape of the portion of the container or "window" is in a shape related to the printed image.

The contents of the unit dose products may include liquids, gels, solids, powders or gasses. The liquids, gels, pastes, solids and powders may comprise detergents. The gas may be included either deliberately, accidentally, as inevitable result of a manufacturing process or be released from one or more of the contents of one or more of the compartments.

Powder Detergent

Powder detergent is herein understood to typically include any detergent in solid form, particularly including powders, granular, spray-dried, agglomerated and compacted detergent compositions and combinations thereof. Preferably, the powder detergent will comprise at least one detergent adjunct selected from the group consisting of builders, chelants, enzymes, bleaches, bleach activators, bleach catalysts, metal protectors, surfactants, glass protectors, soil release polymers, perfumes and anti-scalants and combinations thereof. Preferably the powder is white in color, but may contained colored particles making up less then 50 vol % of the powder detergent, preferably between 0.01 vol % and 50 vol % by volume of the unit dose compartment containing the powder detergent.

Liquid Portion

The liquid portion of the contents encompasses liquids, gels and pastes. The liquid portion may comprise some water, but as it will be contained by a water soluble material, the level of water should be restricted to less than 10% free water, preferably less than 8% free water by weight of the liquid portion. Liquid portion may also contain quantities of low molecular weight primary or secondary alcohols such as methanol, ethanol, propanol and isopropanol can be used in the liquid detergent of the present invention. Other suitable carrier solvents used includes glycerol, propylene glycol, ethylene glycol, 1,2-propanediol, sorbitol, dipropylene glycol and mixtures thereof.

Organic Solvent

In certain embodiments the liquid portion may comprise an organic solvent. The organic solvents should be selected so as to be compatible with the targeted surfaces for cleaning such as fabrics or tableware/cookware as well as being compatible with the different parts of a machine used to clean such surfaces such as a laundry washing machine or an automatic dishwashing machine. Furthermore, the solvent system should be effective and safe to use having a volatile organic content above 1 mm Hg (and preferably above 0.1 mm Hg) of less than about 50%, preferably less than about 30%, more preferably less than about 10% by weight of the solvent system. Also they should have very mild pleasant odors. The individual organic solvents used herein generally have a boiling point above about 150° C., flash point above about 100° C. and vapor pressure below about 0.133 pascal (1 mm Hg), preferably below 0.0133 pascal (0.1 mm Hg) at 25° C. and atmospheric pressure.

Solvents that can be used herein include: i) alcohols, such as benzyl alcohol, 1,4-cyclohexanedimethanol, 2-ethyl-1-hexanol, furfuryl alcohol, 1,2-hexanediol and other similar materials; ii) amines, such as alkanolamines (e.g. primary alkanolamines: monoethanolamine, monoisopropanolamine, diethylethanolamine, ethyl diethanolamine; secondary alkanolamines: diethanolamine, diisopropanolamine, 2-(methylamino)ethanol; ternary alkanolamines: triethanolamine, triisopropanolamine); alkylamines (e.g. primary alkylamines: monomethylamine, monoethylamine, monopropylamine, monobutylamine, monopentylamine, cyclohexylamine), secondary alkylamines: (dimethylamine), alkylene amines (primary alkylene amines: ethylenediamine, propylenediamine) and other similar materials; iii) esters, such as ethyl lactate, methyl ester, ethyl acetoacetate, ethylene glycol monobutyl ether acetate, diethylene glycol monoethyl ether acetate, diethylene glycol monobutyl ether acetate and other similar materials; iv) glycol ethers, such as ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol butyl ether and other similar materials; v) glycols, such as propylene glycol, diethylene glycol, hexylene glycol (2-methyl-2,4 pentanediol), triethylene glycol, composition and dipropylene glycol and other similar materials; and mixtures thereof.

Surfactant

Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$-$C_{20}$, preferably $C_{10}$-$C_{18}$ linear or branched; cationic surfactants such as chlorine esters (U.S. Pat. No. 4,228,042, U.S. Pat. No. 4,239,660 and U.S. Pat. No. 4,260,529) and mono $C_6$-$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$-$C_{18}$ primary alcohols), ethoxylated-propoxylated alcohols (e.g., BASF POLY-TERGENT® SLF18), epoxy-capped poly(oxyalkylated) alcohols (e.g., BASF POLY-TERGENT® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$-$C_{20}$ alkyl amine oxides (preferred amine oxides for use herein include $C_{12}$ lauryldimethyl amine oxide, $C_{14}$ and $C_{16}$ hexadecyl dimethyl amine oxide), and alkyl amphocarboxylic surfactants such as MIRANOL™ C2M; and zwitterionic surfactants such as the betaines and sultaines; and mixtures thereof. Surfactants suitable herein are disclosed, for example, in U.S. Pat. No. 3,929,678, U.S. Pat. No. 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of composition.

Builder

Builders suitable for use herein include water-soluble builders such as citrates, MGDA, GLDA, carbonates and polyphosphates e.g. sodium tripolyphosphate and sodium tripolyphosphate hexahydrate, potassium tripolyphosphate and mixed sodium and potassium tripolyphosphate salts; and partially water-soluble or insoluble builders such as crystalline layered silicates (EP-A-0164514 and EP-A-0293640) and aluminosilicates inclusive of Zeolites A, B, P, X, HS and MAP. The builder is typically present at a level of from about 1% to about 80% by weight, preferably from about 10% to about 70% by weight, most preferably from about 20% to about 60% by weight of composition.

Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Enzyme

Enzymes suitable herein include bacterial and fungal cellulases such as Carezyme and Celluzyme (Novo Nordisk A/S); peroxidases; lipases such as Amano-P (Amano Pharmaceutical Co.), M1 LIPASE® and LIPOMAX® (Gist-Brocades) and LIPOLASE® and LIPOLASE ULTRA® (Novo); cutinases; proteases such as ESPERASE®, ALCALASE®, DURAZYM® and SAVINASE® (Novo) and MAXATASE®, MAXACAL®, PROPERASE® and MAXAPEM® (Gist-Brocades); α and β amylases such as PURAFECT OX AM® (Genencor) and TERMAMYL®, BAN®, FUNGAMYL®, DURAMYL®, and NATALASE® (Novo); pectinases; and mixtures thereof. Enzymes are preferably added herein as prills, granulates, or cogranulates at levels typically in the range from about 0.0001% to about 2% pure enzyme by weight of composition.

Bleaching Agent

Bleaching agents suitable for use herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410).

Other Components

Other suitable components herein include organic polymers having dispersant, anti-redeposition, soil release or other detergency properties invention in levels of from about 0.1% to about 30%, preferably from about 0.5% to about 15%, most preferably from about 1% to about 10% by weight of composition. Preferred anti-redeposition polymers herein include acrylic acid containing polymers such as SOKALAN PA30, PA20, PA15, PA10 and SOKALAN CP10 (BASF GmbH), ACUSOL 45N, 480N, 460N (Rohm and Haas), acrylic acid/maleic acid copolymers such as SOKALAN CP5 and acrylic/methacrylic copolymers. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are suitable for use herein in levels generally from about 0.005% to about 20%, preferably from about 0.1% to about 10%, more preferably from about 0.25% to about 7.5% and most preferably from about 0.5% to about 5% by weight of composition, for example diethylenetriamine penta(methylene phosphonate), ethylenediamine tetra(methylene phosphonate) hexamethylenediamine tetra(methylene phosphonate), ethylene diphosphonate, hydroxy-ethylene-1,1-diphosphonate, nitrilotriacetate, ethylenediaminotetracetate, ethylenediamine-N,N'-disuccinate in their salt and free acid forms.

The compositions herein can contain a corrosion inhibitor such as organic silver coating agents in levels of from about 0.05% to about 10%, preferably from about 0.1% to about 5% by weight of composition (especially paraffins such as WINOG 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the composition.

Other suitable components herein include water-soluble bismuth compounds such as bismuth acetate and bismuth citrate at levels of from about 0.01% to about 5%, enzyme stabilizers such as calcium ion, boric acid, propylene glycol and chlorine bleach scavengers at levels of from about 0.01% to about 6%, lime soap dispersants (see WO-A-93/08877), suds suppressors (see WO-93/08876 and EP-A-0705324), polymeric dye transfer inhibiting agents, optical brighteners, perfumes, fillers and clay.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. Process of randomizing printing onto unit dose products comprising the steps of:

Selecting a water soluble material to be printed, the material having an available width;

Selecting the width of the foot print of a unit dose product to be less than the available width of the water soluble material;

Selecting two or more sizes of a graphic such that at least a first graphic and a second graphic result, wherein the first graphic and second graphic comprise a width such that the first graphic width is greater than the second graphic width;

Printing repeatedly at different locations on the water soluble material in the available width the first size of graphic onto the water soluble material at an angle of between 10 and 25 degrees wherein the distance between the repeatedly printed first graphic oriented parallel to the available width of the water soluble material is between 2.5× and 5× and the distance between the repeatedly printed first graph oriented perpendicular to the available width of the water soluble material is X;

Printing repeatedly at different locations on the water soluble material in the available width the second size of graphic onto the water soluble material at an angle of between 10 and 25 degrees wherein the distance between the repeatedly printed second graphic oriented parallel to the available width of the water soluble material is between 2.5× and 5× and the distance between the repeatedly printed second graph oriented perpendicular to the available width of the water soluble material is X;

Forming the printed water soluble material into unit dose products.

2. The process of claim 1 wherein the water soluble material comprises polyvinyl alcohol.

3. The process of claim 1 wherein the width of the material is greater than an available width of the material.

4. The process of claim 1 further comprises the step of selecting a third graphic, the third graphic being of less width than the first graphic and the second graphic.

5. The process of claim 4 wherein the process further comprises the step of printing repeatedly at different locations on the water soluble material in the available width the third size of graphic onto the water soluble material at an angle of between 10 and 25 degrees wherein the distance between the repeatedly printed third graphic oriented parallel to the available width of the water-soluble material is between 2.5× and 5× and the distance between the repeatedly printed third graph oriented perpendicular to the available width of the water soluble material is X.

6. The process of claim 4 wherein the first graphic, second graphic and third graphic are the same graphic.

7. The process of claim 4 wherein the first graphic, second graphic and third graphic are different graphics.

8. The process of claim 1 wherein the first graphic and the second graphic are the same graphic.

9. The process of claim 1 wherein the first graphic and the second graphic are different graphics.

* * * * *